US010829328B2

(12) United States Patent
Perini

(10) Patent No.: US 10,829,328 B2
(45) Date of Patent: Nov. 10, 2020

(54) MACHINE AND PROCESS FOR THE PRODUCTION OF LOGS OF PAPER MATERIAL

(71) Applicant: FUTURA S.P.A., Capannori (IT)

(72) Inventor: Fabio Perini, Viareggio (IT)

(73) Assignee: FUTURA S.P.A., Capannori (IT)

( * ) Notice: Subject to any disclaimer, the term of this patent is extended or adjusted under 35 U.S.C. 154(b) by 0 days.

(21) Appl. No.: 16/494,460

(22) PCT Filed: Mar. 2, 2018

(86) PCT No.: PCT/IT2018/000031
§ 371 (c)(1),
(2) Date: Sep. 16, 2019

(87) PCT Pub. No.: WO2018/179016
PCT Pub. Date: Oct. 4, 2018

(65) Prior Publication Data

US 2020/0087091 A1 Mar. 19, 2020

(30) Foreign Application Priority Data

Mar. 29, 2017 (IT) ..... 102017000034591

(51) Int. Cl.
*B65H 19/22* (2006.01)

(52) U.S. Cl.
CPC ..... *B65H 19/2269* (2013.01); *B65H 2301/41361* (2013.01)

(58) Field of Classification Search
CPC ..... B65H 19/22; B65H 18/16; B65H 18/26; B65H 19/2238; B65H 19/2269; B65H 2408/235; B65H 2301/41361
See application file for complete search history.

(56) References Cited

U.S. PATENT DOCUMENTS 3,750,973 A * 8/1973 Walters ..... B65H 19/2284 242/418
4,783,015 A 11/1988 Shimizu
(Continued)

FOREIGN PATENT DOCUMENTS

EP 1 700 805 A2 9/2006
EP 2266903 A2 * 12/2010 ..... B65H 18/26
(Continued)

OTHER PUBLICATIONS

International Search Report dated Jul. 12, 2018 in corresponding International Application No. PCT/IT2018/000031; 2 pages.
(Continued)

*Primary Examiner* — William A. Rivera
(74) *Attorney, Agent, or Firm* — Maier & Maier, PLLC

(57) ABSTRACT

Rewinding machine for the production of logs of paper material, including a winding station in which is fed a paper web and, in sequence, more tubular cores, and in which station winding are arranged a first, a second and a third winding roller cooperating with each other to wind a predetermined amount of said paper web onto each core. The machine includes a fourth winding roller which is connected to respective moving elements adapted to arrange it in a first inoperative position until the diameter of a log in the winding station is lower than a first predetermined value and a second operating winding position when the diameter of the log being formed is equal to said first predetermined value, the moving elements being controlled to maintain the fourth roller in the second operating winding position until the diameter of the log reaches a second final value higher of the first predetermined value.

15 Claims, 11 Drawing Sheets

(56) References Cited

U.S. PATENT DOCUMENTS

| | | | | |
|---|---|---|---|---|
| 2009/0236463 | A1* | 9/2009 | Izumida | B65H 18/26 242/547 |
| 2010/0129543 | A1* | 5/2010 | Tsai | B05C 1/0817 427/207.1 |
| 2018/0179009 | A1* | 6/2018 | Perini | B65H 23/00 |
| 2019/0168979 | A1* | 6/2019 | Morelli | B65H 19/2269 |

FOREIGN PATENT DOCUMENTS

| | | | |
|---|---|---|---|
| EP | 3 009 382 | A2 | 4/2016 |
| JP | S50-113667 | A | 9/1975 |
| WO | 2018/037272 | A1 | 3/2018 |

OTHER PUBLICATIONS

International Preliminary Report on Patentability dated Jul. 3, 2019 in corresponding International Application No. PCT/IT2018/000031; 8 pages.

* cited by examiner

MACHINE AND PROCESS FOR THE PRODUCTION OF LOGS OF PAPER MATERIAL

FIELD

The present invention relates to a rewinding machine and a process for producing logs of paper material.

BACKGROUND

It is known that the production of logs of paper material, from which are obtained, for example, rolls of toilet paper or rolls of kitchen paper, implies the feeding of a web of paper, formed by one or more superimposed plyers, on a predetermined path along which various operations are performed before proceeding to the formation of the logs, including a transversal pre-incision of the web to form pre-cut lines which divide it into separable tear-off sheets. The formation of logs normally involves the use of cardboard tubes, commonly called "cores" on the surface of which a predetermined amount of glue is distributed to allow the paper web to be bonded onto the cores gradually introduced into the machine which produces the logs, commonly called "rewinder". The glue is distributed on the cores when they pass along a corresponding path comprising an end section commonly known as "cradle" due to its concave shape. The formation of the logs also implies the use of winding rollers which impose each core to rotate about its longitudinal axis thus determining the winding of the web on the same core. The process ends when a predetermined number of sheets is wound on the core, with the gluing of a flap of the last sheet on the underlying one of the roll thus formed (so-called "flap gluing" operation). Upon reaching the predetermined number of sheets wound on the core, the last sheet of the log being completed is separated from the first sheet of the next log, for example by a jet of compressed air directed towards a corresponding pre-cutting line. At this point, the log is discharged from the rewinder. EP 1700805 discloses a rewinding machine that operates according to the above operating scheme. The logs thus produced are then conveyed to a storing unit that supplies one or more cutting-off machines by means of which the transverse cutting of the logs is carried out to obtain the rolls having the desired length.

U.S. Pat. No. 4,783,015 discloses a rewinding machine in which the unit for winding the paper on the cores comprises four rolls sequentially used in groups of three: initially a first group of three rolls provides for the winding of a first quantity of paper on the core and, in a second phase, a second group of three rollers completes the winding.

In practice, the system disclosed in U.S. Pat. No. 4,783,015 involves the use of four winding rollers positioned and controlled so as to form two consecutive nips in which a first and a second part of the winding are respectively realized, with a step of transition of the log being formed from the first to the second nip. One of said nips is formed by three of the four rollers, while the second nip is formed by two of the first three rollers and by a further roller which is not used during the first winding phase. A system of the same type is disclosed in EP3009382A2. In both the cases referred to above, the use of two separate groups of three winding rollers in the initial and final winding phases allows to use three angularly equidistant rollers each time, i.e. three winding rollers whose axes are contained in planes which are mutually spaced of 120°. This allows the logs to be contained, particularly in the final phase of the winding, within a space defined by three winding rollers arranged symmetrically with respect to the core.

In some rewinders, due to the lack of available space and to the shape and the arrangement of some auxiliary components in the winding area where the paper is wound on the cores, it is not possible to implement a constructive solution based on the principle described in U.S. Pat. No. 4,783,015 and EP3009382A2. However, the need to stabilize the log is still felt, particularly in the intermediate and final phases of the winding. In addition, the need to reduce as much as possible the amount of glue used is still felt, with particular reference to rewinders in which on the core is initially distributed both the glue that allows the web to adhere to the core and the glue allowing the last sheet of the log being formed to adhere to the underlying sheets (so-called "flap gluing").

SUMMARY

The main object of the present invention is to provide a solution to the problems indicated above.

This result has been achieved, in accordance with the present invention, by providing a rewinder and a process as indicated in the independent claims. Other features of the present invention are described in the dependent claims.

Among the advantages offered by the present invention, the following are cited for example: it is possible to stabilize the logs being formed, particularly in the intermediate and final phases of the winding, without requiring two separate winding nips, with positive effects in terms of space required and of duration of the process, since a phase of transition of the log from the first to the second nip of the known systems is eliminated; it is possible to reduce the amount of glue used in the gluing phase, with benefits related both to the lower consumption of glue, and to the contamination of the winding area by the same glue; it is possible to complete the gluing phase more efficiently despite the use of a lower amount of glue.

BRIEF DESCRIPTION OF THE DRAWINGS

These and further advantages and characteristics of the present invention will be more and better understood by any person skilled in the art, thanks to the following description and to the attached drawings, provided as an example but not to be considered in a limiting sense, in which.

Figure 1:
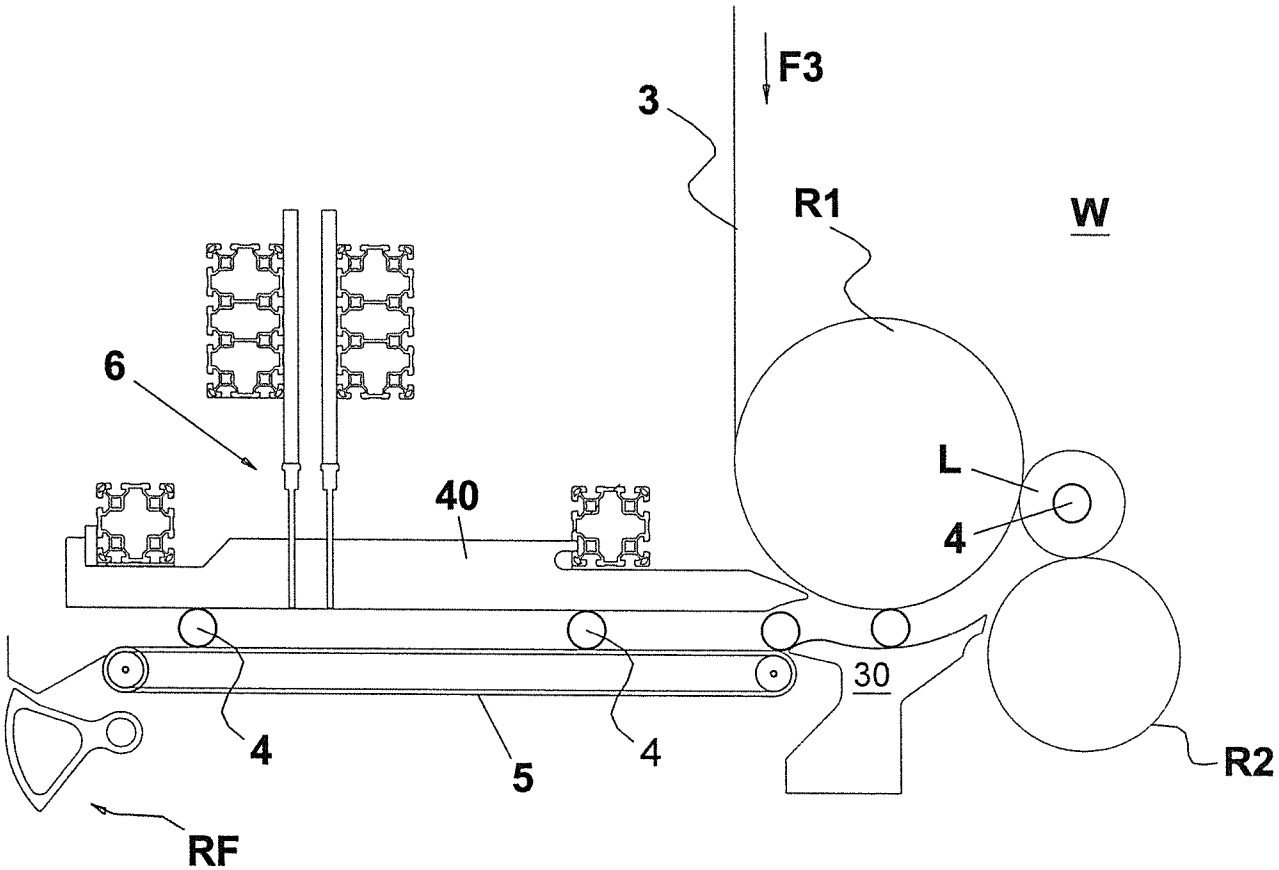
FIG. 1 schematically represents a rewinder which can be equipped with a winding mechanism according to the present invention.

A rewinding machine (RW) which can be equipped with a paper winding mechanism in accordance with the present invention comprises a first winding roller (R1) and a second winding roller (R2) suitable for delimiting, with their respective outer surfaces, a nip ( ) through which a paper web (3), consisting of one or more paper plies and destined to be wound around a tubular core (4), is fed to form a log (L). The web (3) is provided with a series of transversal incisions or pre-cuts which divide the web into consecutive sheets and facilitate the separation of the individual sheets. Each log (4) is formed by a pre-established number of sheets wound on the core (4). During the formation of the log, the diameter of the latter increases up to a predetermined maximum value which corresponds to a predetermined length of the web (3), i.e. to a predetermined number of sheets. Upstream of the aforementioned nip (N), with respect to the direction (F3) from which the web (3) comes, a rotating feeder (RF) is provided for sequentially feeding the cores (4) to allow a continuous production of the logs (L). The cores (4) follow a feeding path along which a glueing unit (6) is placed for distributing a predetermined amount of glue on each core (4). The aforesaid path is delimited by a series of plates (40) placed side by side and placed above a conveyor (5). The gluing unit (6) applies the glue on two distinct areas of each core (4) to glue the last sheet of a log being formed into the winding station (W) with the underlying sheet of the same log ("flap gluing") and to allow the adhesion of the first sheet of a new log on the surface of a corresponding core (4) as known to those skilled in the art.

For the purposes of the present description, the winding station (W) is the point of the rewinding machine where the winding rollers are arranged and acting.

In the winding station (W) a third winding roller (R3) is arranged which, with respect to said direction (F3) followed by the web (3), is arranged downstream with respect to the first two winding rollers (R1, R2). Furthermore, the second winding roller (R2) is arranged at a lower level than the first roller (R1) with respect to the basement of the machine. In the embodiment shown in the accompanying drawings, the positions of the axes of the first roller (R1) and the second roller (R2) are fixed. The third roller (R3) is above the second roller (R2) and has respective axial ends (S3, S30) connected, as further indicated below, to an actuator (A3) allowing it to he moved to and from the second roller (R2), that is, as further described in the following, allowing to move it from and towards the aforesaid nip (N). With reference to the embodiment illustrated in the accompanying drawings, the actuator (A3) is a rotary actuator.

A fourth roller (R4) is provided in the winding station (W).

The axes of said rollers (R1, R2, R3, R4) are parallel to each other.

On one end (S30) of the third roller (R3), for example the right-hand end with reference to FIG. 5, a corresponding toothed wheel (RS30) is keyed with an intermediate toothed wheel (RF) and the latter, in turn, engages a toothed drive wheel (RM) driven by a respective electric motor (M). In this way, the third roller (R3) is powered by the motor (M) which, therefore, controls its rotation around the respective axis (X3). On the other end (S3) of the third roller (R3) a toothed wheel (RS3) is mounted which, through an intermediate toothed wheel (RFD), meshes with a toothed wheel (RS4) keyed on one end (S4) of the fourth roller (R4). With reference to FIG. 5, the toothed wheel (RS4) is keyed on the left end (S4) of the fourth roller (R4). Consequently, the motor (M) also controls the rotation of the fourth roller (R4) around the respective axis (X4). In other words, the motor (M) determines the rotation of the third roller (R3) around its own axis (X3) by means of the transmission (RM, RF, RS30), and the roller (R3) in turn determines the rotation of the fourth roller (R4) around its own axis (X4) through transmission (RS3, RFD, RS4). In practice, the third roller (R3) constitutes an element for transmitting the motion from the motor (M) to the fourth roller (R4).

Figures 5A, 5B, 5C:
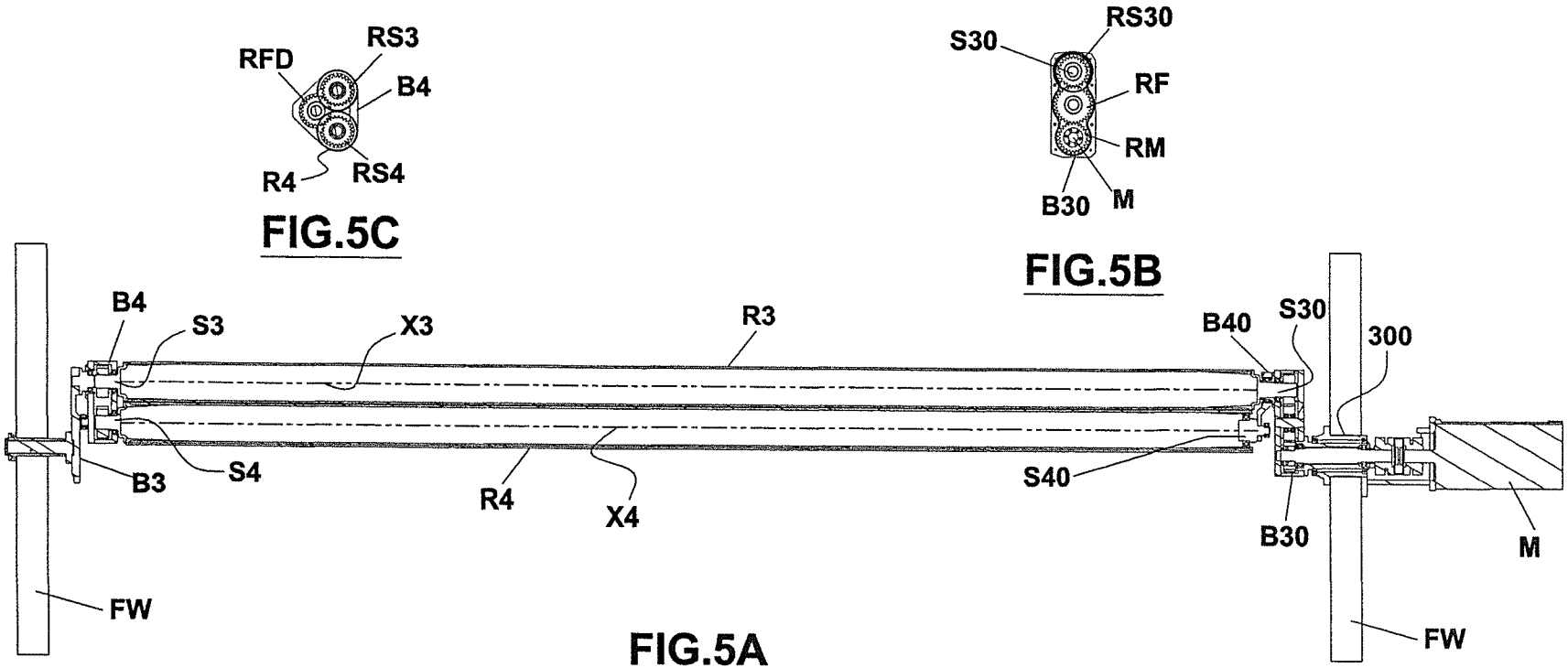
FIG. 5A is a schematic horizontal section view of the group formed by rollers (R3) and (R4)
FIG. 5B is a view of the arm (B30) and the gears housed in the same arm.
FIG. 5C is a view of the arm (B4) and the gears housed in the same arm.
Figure 6:
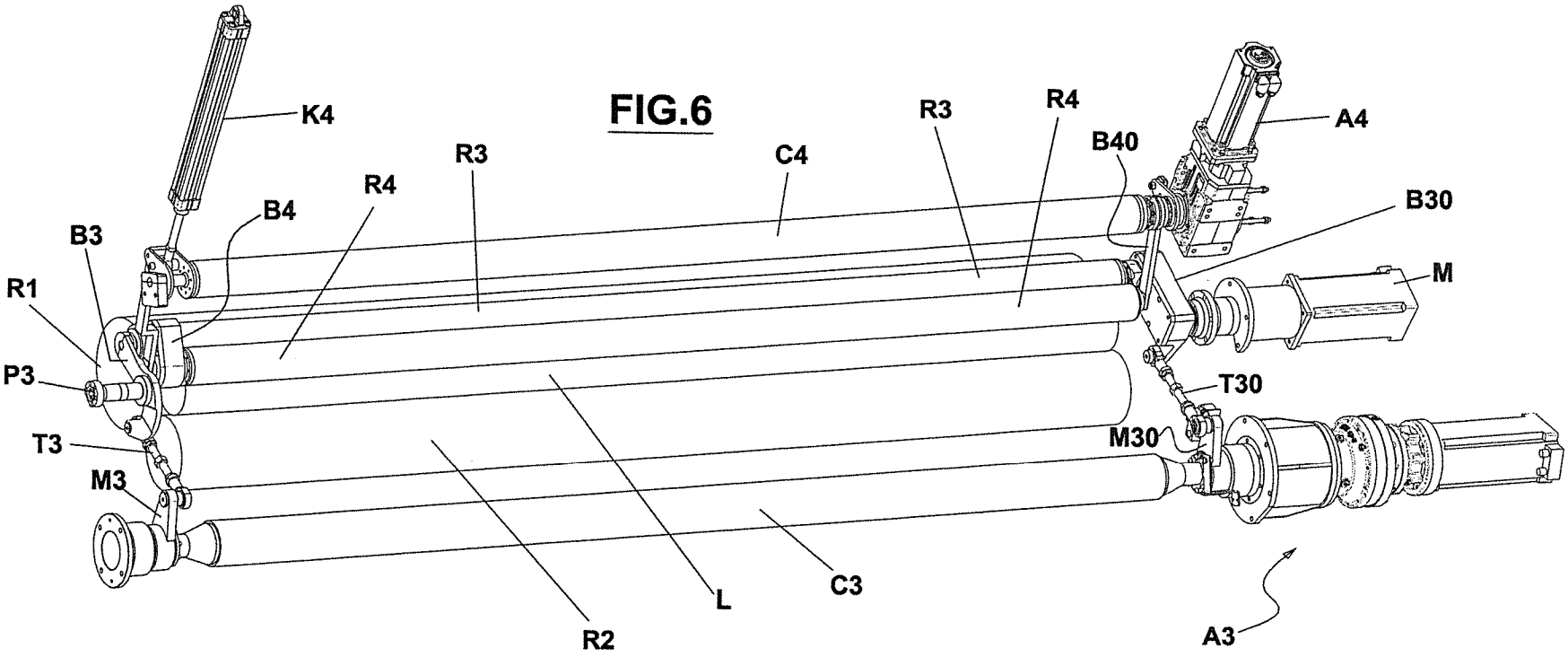
FIG. 6 shows a schematic perspective view of a possible embodiment of the system for moving the rollers (R3) and (R4)

The third roller (R3) is supported by a right arm (B30) and a left arm (B3). In particular, the right arm (B30) is box-like shaped and contains the transmission gears (RM, RF, RS30). Furthermore, the right arm (B30) is connected to the rotary actuator (A3) by means of corresponding articulated levers (M30) and (T30). The right arm (B3) is a hook-shaped arm and is hinged on a fixed pin (P3) bound to a fixed wall (FW) of the rewinder (RW). The axis of the pin (P3) is horizontal and parallel to the axes (X3, X4) of the rollers (R3, R4). Moreover, as shown in FIG. 5A and FIG. 6, the axis of the pin (P3) coincides with the axis of the output shaft of the motor (M) passing through a hushing (300) inserted in the side (FW) of the rewinder opposite to the one in which the pin (P3) is inserted. The right arm (B3) is connected to the actuator (A3) by means of two articulated levers (M3, T3) one of which (M3) is applied on a bar (C3) actuated by the actuator (A3).

DETAILED DESCRIPTION

In this way, the roller (R3) can be arranged in a position which is more or less distant from the core (4) in relation to the instantaneous diameter of the log being formed, as further described below. In other words, the actuator (A3) controls the rotation of the third roller (R3) around the axis of the pin (P3) and both the third and the fourth roller can rotate about the respective axes (X3, X4) under control of the motor (M).

According to the present invention, the log is completed by associating the fourth roller (R4) with the first three (R1, R2, R3) so that the final phase of the paper winding on the core involves the use of all four rollers (R1, R2, R3, R4) which, in this phase, surround the log and define a space having a variable volume in which the formation of the same log is completed.

In other words, in accordance with the present invention until the diameter of the log being formed in the station (W) is lower than a predetermined value (for example, 90 mm), the fourth roller (R4) is in the inoperative position and, upon reaching of said predetermined value, it is in the operating winding position, contributing with the other three rollers (R1, R2, R3) to the winding of the web (3) on the core (4) until the final log diameter is reached (for example, 140 mm). In the inoperative position, the fourth roller (R4) is spaced from the log in formation while in the operating winding position it is in contact with the log (L).

The fourth roller (R4) is connected to a corresponding positioning actuator (A4) which allows it to be placed in the raised or inoperative position (A) and in the winding operating position (B), respectively, as further described below. The lowered position (B) of the fourth roller (R4) is the position of the latter in the completion phase of the log.

With reference to the embodiment shown in the accompanying drawings, the fourth roller (R4) is connected to the respective positioning actuator (A4) by means of a right arm (B40) and a left arm (B4) which support the respective right end (S40) and left end (S4). On each of said arms is mounted a transmission with articulated levers (M40, T40; M4, T4) that connects it to a horizontal bar (C4) operated by the actuator (A4). Said arms (B40, B4) are hinged on the axis (X3) of the third roller. Therefore, the actuator (A4) controls the rotation of the fourth roller (R4) about the axis (X3) of the third roller (R3). The left arm (B4) has a box-shaped structure and contains the transmission gears (RS3, RFD, RS4).

Therefore the mechanism described above allows the following movements: a) rotation of the third roller (R3) about its axis (X3);

b) rotation of the fourth roller (R4) about its axis (X4);

c) rotation of the third roller (R3) about the axis of pin (P3);

d) rotation of the fourth roller (R4) about the axis (X3) of the third roller (R3). In particular, the rotation c) corresponds to the movement of the third roller (R3) from and towards the nip (N), similarly to the rotation d) that concerns the fourth roller (R4).

Once the log winding in the station (W) is completed, the fourth roller (R4) is returned to the initial raised position (A) to free the finished log (LI) as further described below.

The four winding rollers (R1, R2, R3, R4) cooperate with each other only in the phase of completion of the web (3) winding on the core (4). In the initial phase of winding, i.e. until the diameter of the log being formed is smaller than a predefined value, only the first three rollers (R1, R2, R3) are used, and these rollers realize the initial phase of the winding according to a scheme per se known. The intervention of the fourth roller (R4) in the phase of completion of the log determines a multiplicity of advantages. In fact, it acts as a press roller which presses the last sheet of the log onto the underlying one in the final winding phase and therefore contributes to the gluing of the flap even if a smaller amount of glue is used due to the pressure exerted thereby. At the same time, the fourth roller (R4) contributes to precisely keeping of the log (L) in the winding station (W). In fact, despite the substantially asymmetric arrangement of the first three rollers (R1, R2, R3) with respect to the core (4), the positioning of the fourth roller (R4) in the lowered position (winding operating position "B") contributes to delimit a space in which the log (L) being formed is perfectly contained, so that the negative effects of the oscillations of the same log are practically eliminated, oscillations normally due to the speed of execution of the winding and to the structure of the log. Moreover, when the log formation is completed and the fourth roller (R4) is returned to the initial raised position (A), the completed log can be moved out from the winding station (W) through the side previously occupied by the same fourth roller (R4) to allow the start of a new cycle.

According to a further aspect of the present invention, when using a rewinder provided with a deceleration system of the logs downstream of the winding station (W), the fourth roller (R4) favors the entry of the logs into the deceleration system.

For example, with reference to FIGS. 2A-2H and FIGS. 3A-3H, said deceleration system comprises a plurality of deceleration rolls (D1, D2, D3) per se known. In practice, the deceleration rollers (D1, D2, D3) are positioned along a direction parallel to the output plane of the logs (ER) arranged downstream of the winding station (W). Each of the deceleration rollers (D1, D2, D3) rotates with a predetermined angular velocity around its own axis. Therefore, thanks to the contact between the rollers (D1, D2, D3) and the log (LI) exiting along the output plane (ER), the log speed along the output plane (ER) is controlled by the rollers (D1, D2, D3), preventing the log (LI) from coming out of the rewinder in an uncontrolled manner.

With reference to a rewinder equipped with a deceleration system of the logs of this type, the fourth roller (R4), in its relocation movement in the raised position (A), is able to accompany the finished log (LI) towards the output, such that the fourth roller is also a component of the deceleration system and not just a component of the winding system.

The following description refers to two possible examples of operational use of a winding system in accordance with the present invention.

The first example will be described with reference to FIGS. 2A-2H.

Figure 2A:
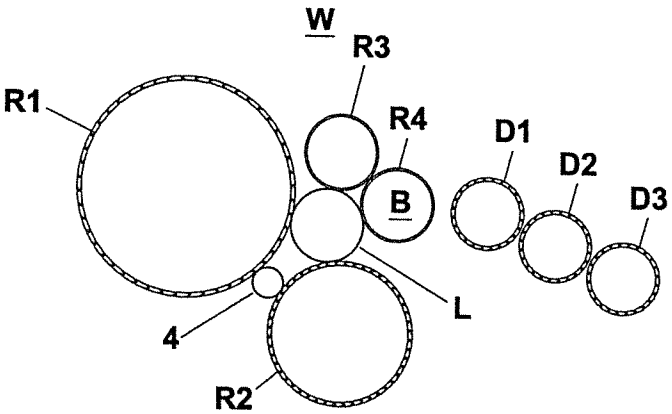
FIG. 2A schematically represents the winding station of a rewinder according to the present invention with the rollers (R1, R2, R3, R4) in another operating position.
Figure 2B:
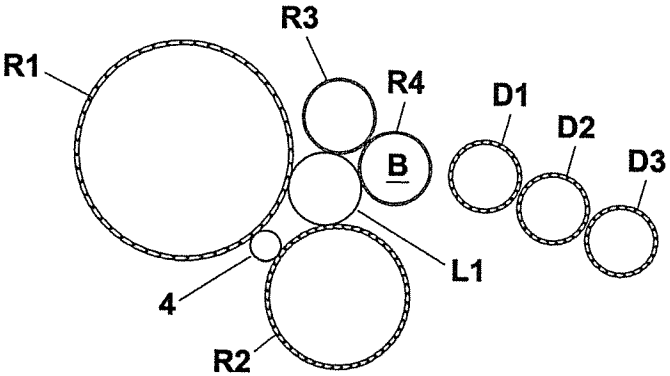
FIG. 2B schematically represents the winding station of a rewinder according to the present invention with the rollers (R1, R2, R3, R4) in another operating position.
Figure 2C:
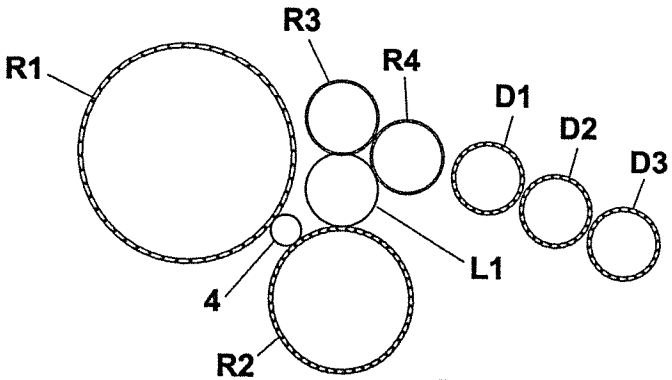
FIG. 2C schematically represents the winding station of a rewinder according to the present invention with the rollers (R1, R2, R3, R4) in another operating position.
Figure 2D:
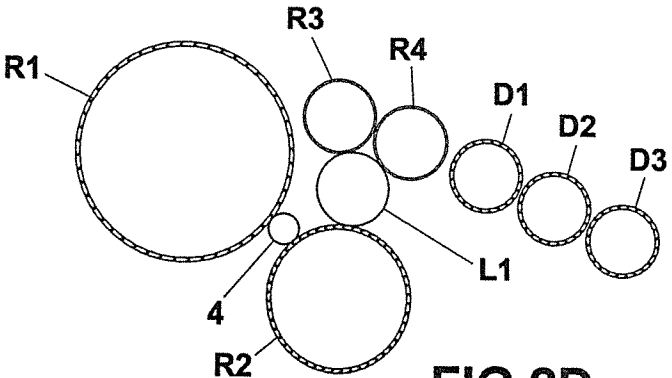
FIG. 2D schematically represents the winding station of a rewinder according to the present invention with the rollers (R1, R2, R3, R4) in another operating position.
Figure 2F:
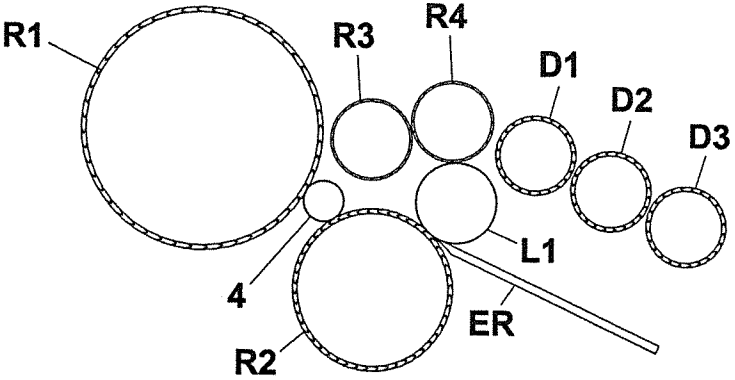
FIG. 2F schematically represents the winding station of a rewinder according to the present invention with the rollers (R1, R2, R3, R4) in another operating position.
Figure 2H:
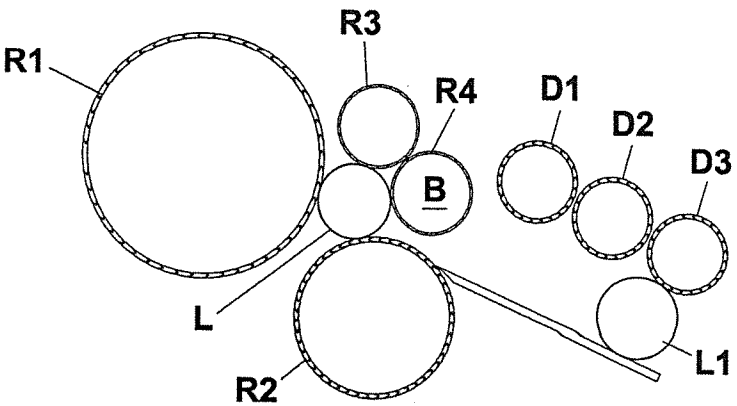
FIG. 2H schematically represents the winding station of a rewinder according to the present invention with the rollers (R1, R2, R3, R4) in another operating position.
Figure 2E:
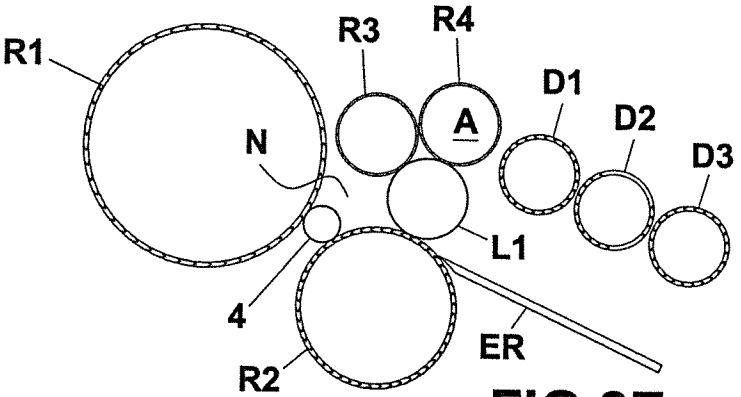
FIG. 2E schematically represents the winding station of a rewinder according to the present invention with the rollers (R1, R2, R3, R4) in another operating position.
Figure 2G:
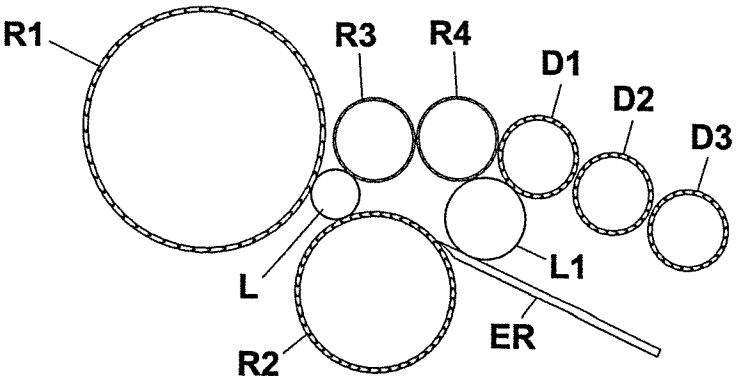
FIG. 2G schematically represents the winding station of a rewinder according to the present invention with the rollers (R1, R2, R3, R4) in another operating position.

Starting from the phase shown in FIG. 2A, where the log (L) is in the completition phase and a core (4) is already positioned upstream between the rollers (R1) and (R2), all four rollers (R1, R2, R3, R4) are in contact with the log (L). In this phase, the roller (R3) and the roller (R4) are in the winding position. In particular, the roller (R4) is lowered into the operating winding position (B). In FIG. 2B the log is completed, the rollers (R3) and (R4) are in the previously assumed positions and the roller (R4), continuing to rotate, exerts on the completed log (LI) a pressure that assists and favors the gluing of the flap. In the subsequent phase shown in FIG. 2C, while the roller (R4) is raised, the roller (R3) remains in the position of the previous phase and accelerates, whereby the completed log (LI) is detached from the first roller (R1) and is pushed towards the fourth roller (R4). In the meantime, the core (4) on which the next log will be formed advances between the rollers (R1) and (R2). In the phase shown in FIG. 2C the completed log (LI) is temporarily in contact with the rollers (R2) and (R3). In the next step (FIG. 2D), while the fourth roller (R4) is further raised, the third roller (R3) is lowered and the completed log (LI) moves further away from the winding station. In the subsequent phase shown in FIG. 2E, the third roller (R3) is further lowered and the fourth roller (R4) continues to rise until it reaches the maximum raising position (A), while the completed log (LI) continues to move away from the winding station. Then (FIG. 2F), while the third roller (R3) descends towards the arrival point of the new core (4), the fourth roller (R4) is lowered and pushes the finished log (LI) towards the first deceleration roller (D1). In this phase, the fourth roller (R4) assists the expulsion of the finished log (LI) from the winding station. In the next phase (FIG. 2G), while the further descent of the third roller (R3) determines the contact of the latter with the new log (L) that substitutes the one previously completed, the further lowering of the fourth roller (R4) determines the final delivery of the finished log (LI) to the deceleration rollers (D1, D2, D3). In the phase shown in FIG. 2H the log (L) has reached a predetermined diameter (for example, 90 mm) and the fourth roller (R4) is lowered again in the winding operating position (B). In this phase, all four rollers (R1, R2, R3, R4) are in contact with the log (L) which continues to be formed, until it is complete.

The second example will be described with reference to FIGS. 3A-3H.

Figure 3A:
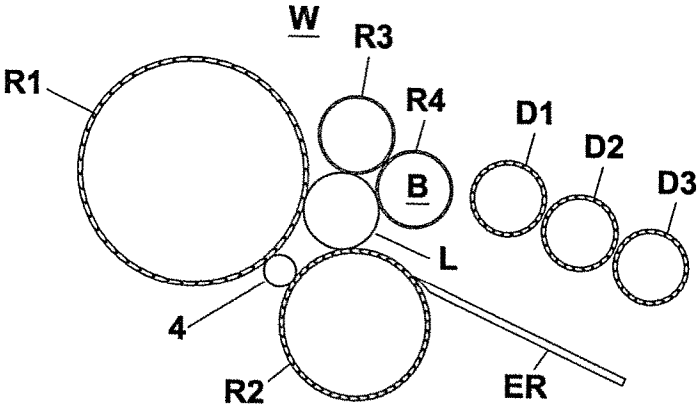
FIG. 3A schematically represents the winding station of a rewinder according to the present invention with the rollers (R1, R2, R3, R4) in an operating position and the rollers (R3, R4) different from that shown in FIGS. 2A-2H.
Figure 3B:
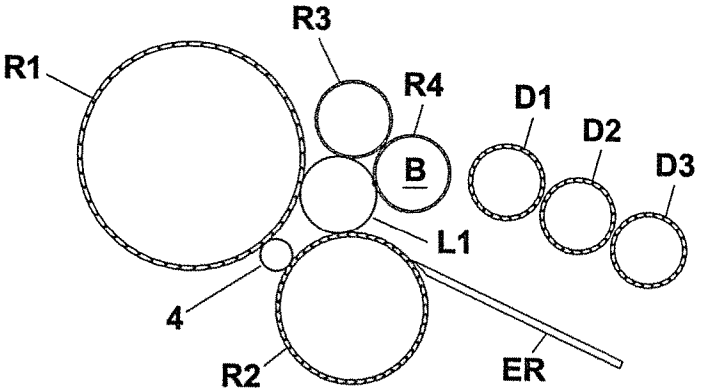
FIG. 3B schematically represents the winding station of a rewinder according to the present invention with the rollers (R1, R2, R3, R4) in another operating position and the rollers (R3, R4) different from that shown in FIGS. 2A-2H.
Figure 3C:
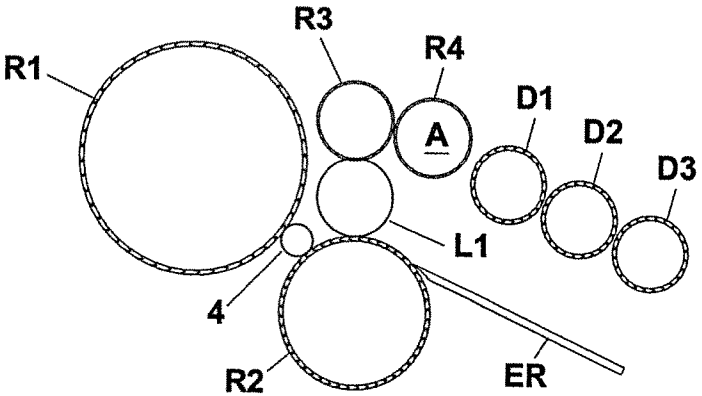
FIG. 3C schematically represents the winding station of a rewinder according to the present invention with the rollers (R1, R2, R3, R4) in another operating position and the rollers (R3, R4) different from that shown in FIGS. 2A-2H.
Figure 3D:
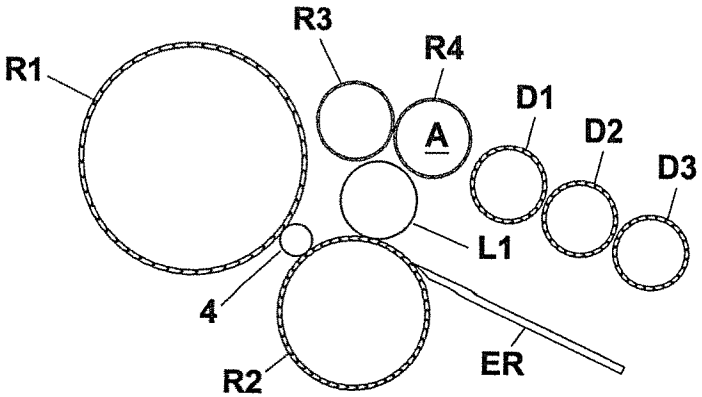
FIG. 3D schematically represents the winding station of a rewinder according to the present invention with the rollers (R1, R2, R3, R4) in another operating position and the rollers (R3, R4) different from that shown in FIGS. 2A-2H.
Figure 3F:
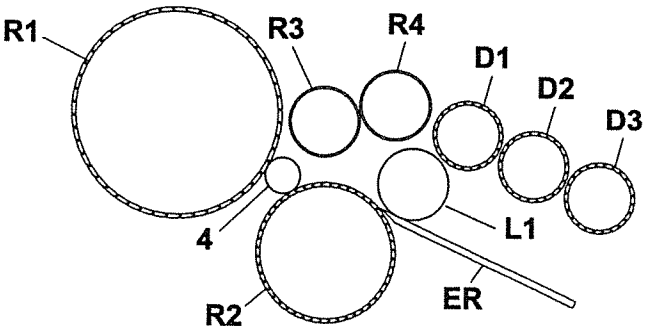
FIG. 3F schematically represents the winding station of a rewinder according to the present invention with the rollers (R1, R2, R3, R4) in another operating position and the rollers (R3, R4) different from that shown in FIGS. 2A-2H.
Figure 3H:
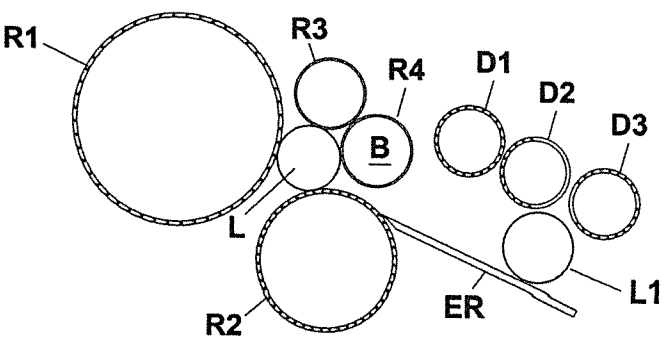
FIG. 3H schematically represents the winding station of a rewinder according to the present invention with the rollers (R1, R2, R3, R4) in another operating position and the rollers (R3, R4) different from that shown in FIGS. 2A-2H.
Figure 3E:
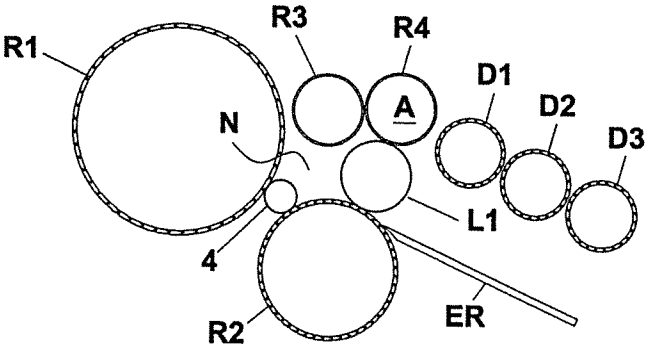
FIG. 3E schematically represents the winding station of a rewinder according to the present invention with the rollers (R1, R2, R3, R4) in another operating position and the rollers (R3, R4) different from that shown in FIGS. 2A-2H.
Figure 3G:
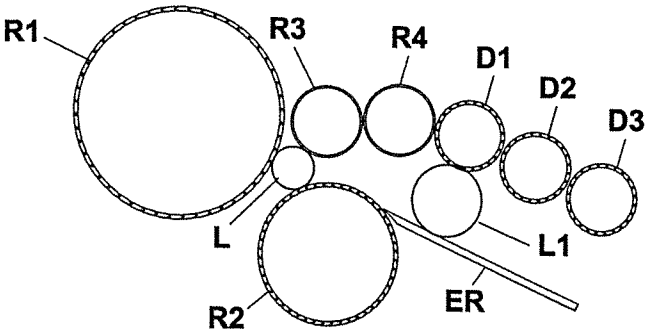
FIG. 3G schematically represents the winding station of a rewinder according to the present invention with the rollers (R1, R2, R3, R4) in another operating position and the rollers (R3, R4) different from that shown in FIGS. 2A-2H.
Figure 4:
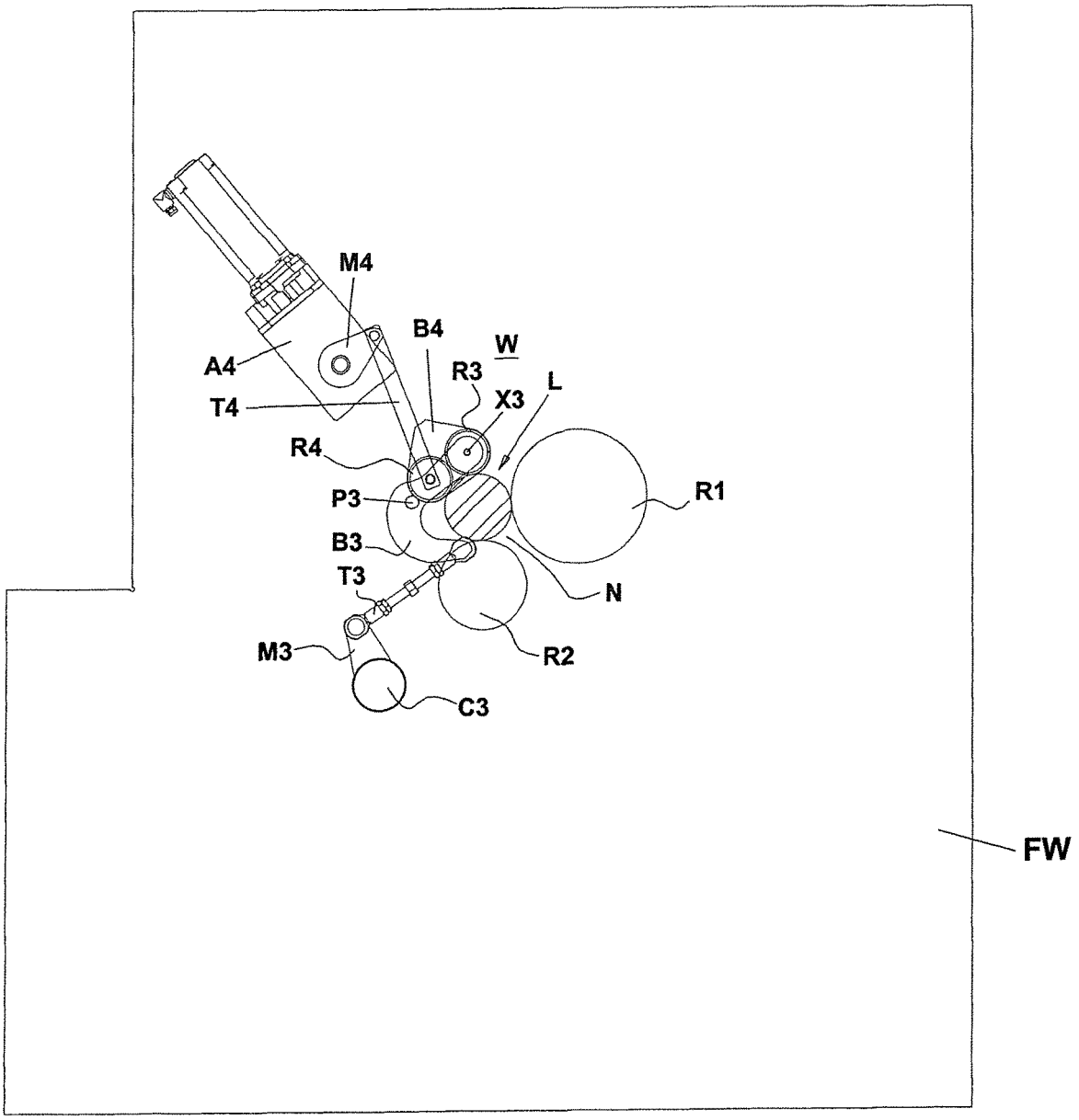
FIG. 4 is a schematic side view in transparency of the winding station, in which the control means controlling the position of the rollers (R3) and (R4) are visible.

Starting from the phase shown in FIG. 3A, where the log (L) is being completed and a core (4) is already positioned upstream between the rollers (R1) and (R2), all four rollers (R1, R2, R3, R4) are in contact with the log (L). In this phase, the roller (R3) and the roller (R4) are in the winding position. In particular, the roller (R4) is lowered in the operating winding position (B). In FIG. 3B the log is completed, the rollers (R3) and (R4) are in the previously assumed positions and the roller (R4), continuing to rotate, exerts on the finished log (LI) a pressure that assists and favors the flap gluing. Upon reaching the predetermined maximum diameter of the log (FIG. 3C), the fourth roller (R4) is quickly raised up to the raised position (A) and consequently the finished log (LI) is detached from the first roller (R1) thus resulting between the roll (R3) and the roller (R2). In a subsequent phase (FIG. 3D), the completed log (LI) moves towards the output (to the right in the drawing) and comes into contact with the fourth roller (R4). In the subsequent phase shown in FIG. 3E the third roller (R3) is lowered towards the point where a new log will be formed and the fourth roller (R4) pushes the completed log (LI) towards the deceleration rollers (D1, D2, D3). In this phase, the completed log (LI) is temporarily in contact only with the fourth roller (R4) and the second roller (R2). FIG. 3F shows a subsequent phase in which the completed log (LI) is between the output plane (ER) and the first deceleration roller (D1), while the third roller (R3) is further lowered towards the point of formation of the new log (L) previously occupied by the completed log. In the next phase shown in Fig. SG the third roller (R3) is in contact with the new log to be formed (L) and the completed log (LI) is further advanced on the output plane (ER). Finally, in the phase shown in FIG. 3H, the log (L) has reached a predetermined diameter (for example, 90 mm) and the fourth roller (R4) is lowered again in the winding operating position (B). In this phase, all four rollers (R1, R2, R3, R4) are in contact with the log (L) which continues to be formed, until it is completed.

In both cases described, when the final diameter of the log is reached, the web (3) is interrupted according to methods known to those skilled in the art and, following this interruption, the production of the new log can be started.

In practice, while in the process described with reference to FIGS. 2A-2H the movement of the fourth roller (R4) between positions (B) and (A) is progressive, in the process described with reference to FIGS. 3A-3H such movement is not progressive. In other words, in the process described with reference to FIGS. 3A-3H the movement of the fourth roller (R4) between positions (B) and (A) is a fast movement obtainable, for example, by connecting a pneumatic spring (4) on the bar (C4) actuated by the actuator (A4): the pneumatic spring (K4) contrasts the descent of the fourth roller (R4) controlled by the actuator (A4) but assists the latter in the ascent phase (passage from position B to position A) making it faster. From the foregoing description it results that a rewinding machine for producing logs from a paper web in accordance with the present invention comprises a winding station (W) in which a web (3) of paper material and, in sequence, several tubular cores (4) are fed; in said winding station (W) a first, a second and a third winding roller (R1, R2, R3) are arranged cooperating with each other to wind a predetermined amount of said web (3) on each core (4); there is a fourth winding roller (R4) which is connected to respective moving means adapted to position it in a first inoperative position (A) until the diameter of the log (L) being formed is lower than a first predetermined value and in a second operating position (B) when the diameter of the log (L) being formed is equal to said first predetermined value; said movement means being controlled to maintain the fourth roller (R4) in the second winding operating position (B) until the log diameter reaches a second final value greater than the first so that, in a first phase which ends with the achievement of said first predetermined value of the diameter of the log being formed, the winding of the web (3) on the cores (4) is carried out by said first, second and third winding roll (R1, R2, R3), and, in a subsequent step, the log is completed in cooperation by the four winding rollers (R1, R2, R3, R4) until the said second predetermined value of the log diameter is reached.

According to a further aspect of the invention, the third roller (R3) is connected to respective movement means adapted to move it cyclically from and towards an arrival point of the cores (4) defined between the lust and the second winding roller (R1, R2).

According to a further aspect of the invention, the axes of said four rollers (R1, R2, R3, R4) are parallel to each other.

According to a further aspect of the invention, the movement of the fourth roller (R4) between the inoperative position (A) and the operating winding position (B) is progressive. Alternatively, the movement of the fourth roller (R4) between the inoperative position (A) and the operating winding position (B) is not progressive but it is a snap movement.

In addition, a process for producing logs of paper material according to the present invention involves the feeding a web (3) of paper material and, in sequence, several tubular cores (4) in a winding station (W) of a rewinding machine; in the winding station (W) a first, a second and a third winding roll (R1, R2, R3) are arranged cooperating with each other to wind a predetermined amount of said web (3) on each core (4); the process involves providing a fourth winding roll (R4) which is arranged in a first inoperative position (A) until the diameter of the log (L) being formed is lower than a predetermined first value and in a second operating position (B) when the diameter of the log (L) being formed is equal to said first predetermined value; said fourth winding roll (R4) is kept in the second operating position of winding (B) until the log diameter reaches a second final value greater than the first so that, in a first step which ends with the achievement of said first predetermined value of the diameter of the log being formed, the winding of the web (3) on the cores (4) is formed by said first, second and third winding rollers (R1, R2, R3), and, in a subsequent step, the log is completed in cooperation by the four winding rollers (R1, R2, R3, R4) until the said second predetermined value of the log diameter is reached.

The process can be further characterized by the fact that said third roller (R3) is moved cyclically from and towards an arrival point of the cores (4) defined between the first and the second winding roller (R1, R2).

Similar to what has been said previously with reference to the rewinding machine, the process of the present invention can be further characterized by the fact that the movement of the fourth roller (R4) between the inoperative position (A) and the operating winding position (B) is a progressive movement or it is a snap movement.

Figure 7A:
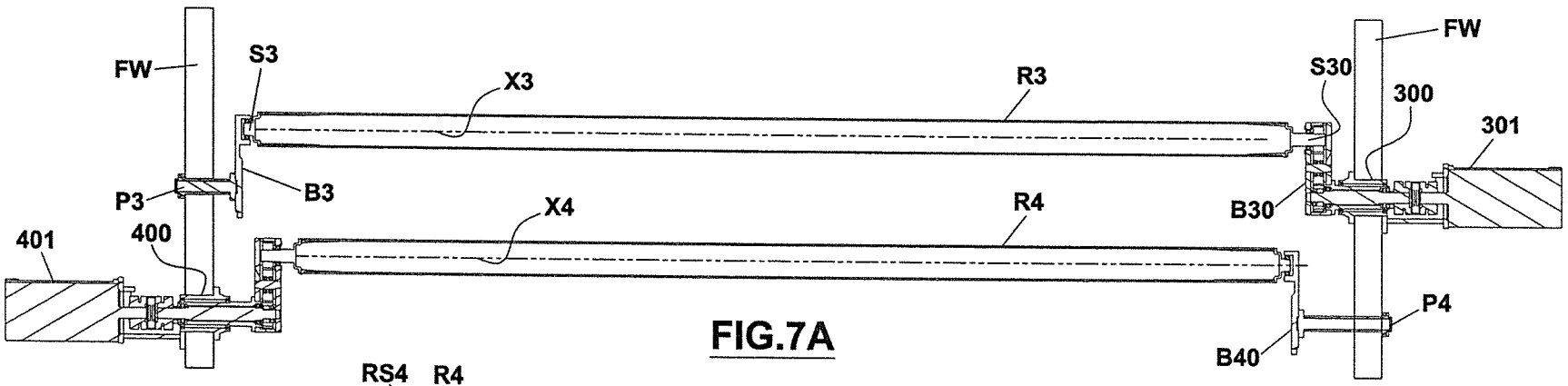
FIG. 7A is similar to FIG. 5A but refers to a different embodiment of the system for moving the rollers (R3) and (R4)
Figure 7B:
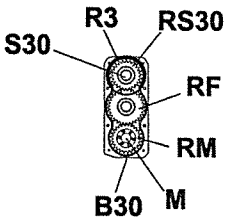
FIG. 7B is a view similar to that of FIG. 5B, but it refers to the example shown in FIG. 7A.
Figure 7C:
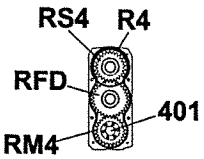
FIG. 7C is a view similar to that of FIG. 5C, but it refers to the example shown in FIG. 7A.

According to the example shown in FIGS. 7A-7C, the rotation of the rollers (R3) and (R4) is controlled by two independent motors (301, 401). More particularly, one end (S30) of the third roller (R3) is inserted in the box-shaped arm (B30) which houses the transmission (RM, RF, RS30) driven by the motor (301) as already described in relation to the example shown in FIGS. 5A-5C. The other end (S3) of the third roller (R3) is inserted in the arm (B3) connected to the corresponding side (FW) of the rewinder by means of the pin (P3). As in the example described above, the pin (P3) is coaxial with the motor shaft (301) which passes through the bush (300) inserted in the respective side of the rewinder. Similarly, the end (S4) of the fourth roller (R4) is inserted in the box-shaped arm (B4) which houses the transmission (RS4, RFD, RM4) driven by the motor (401) as already described in relation to the example shown in FIGS. 5A-5C. The other end (S40) of the fourth roller (R4) is inserted in the arm (B40) connected to the corresponding side (FW) of the rewinder by means of the pin (P4) coaxial with the motor shaft (401) that passes through a respective bushing (400) inserted in said side (FW). In this way, the rollers (R3) and (R4) are driven independently by the motors (301) and (401). Similar to the example previously described, the arms (B3, B30) supporting the third roller (R3) are connected to a rotary actuator (A3) allowing the third roller to be moved to and from the nip (N) with a rotary motion around the axis of the pin (P3). As already described for the previous example, said arms (B3, B30) are connected to the actuator (A3) by means of articulated levers (T3, M3). Likewise, the arms (B4, B40) supporting the fourth roller (R4) are connected to the rotary actuator (A4) allowing the fourth roller to be moved from and towards the nip (N) with a rotary movement about the axis of the pin (P4).

Figure 8A:
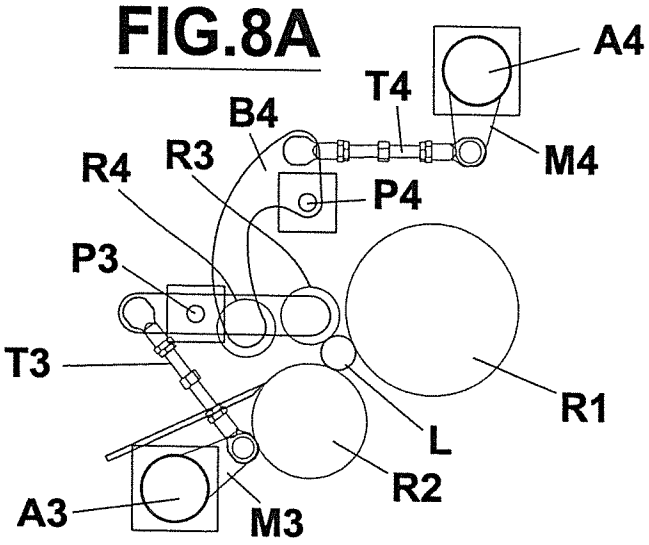
FIGS. 8A-8D schematically show the movements of the third roller (R3) and the fourth roller (R4) when the movement system shown in FIG. 7*a* is used.
Figure 8B:
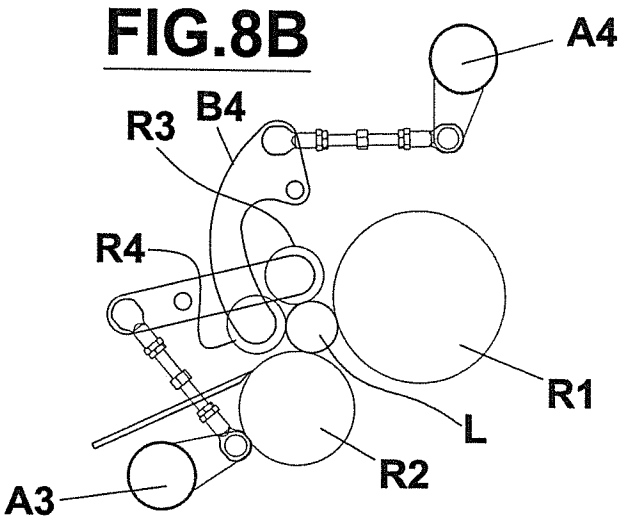
Figure 8C:
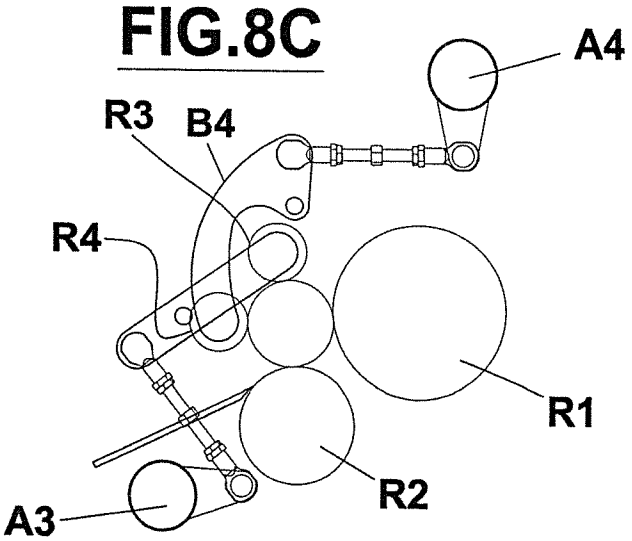
Figure 8D:
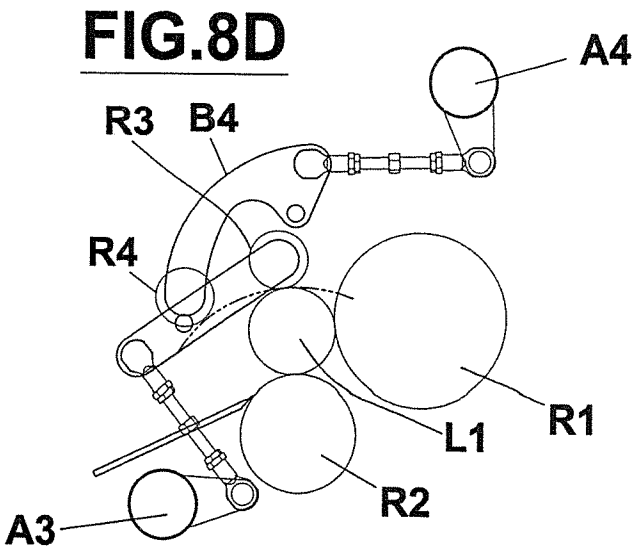

FIGS. 8A-8D schematically illustrate the movements of the third roller (R3) and the fourth roller (R4) when the movement system shown in FIG. 7A is used. In FIG. 8A the third roller (R3) is in the winding position on the log (L) while the fourth roller (R4) is raised in an inoperative position. In FIG. 8B, since the diameter of the log (L) has reached a first predetermined value, the fourth roller (R4) is lowered and positioned in contact with the log (L). In FIG. 8C all four rollers (R1, R2, R3, R4) are completing the winding of the paper on the core to complete the production of the log. In FIG. 8D, while the fourth roller (R4) is raised again, the rotation speed of the third roller (R3) about its axis increases and the finished log (LI) is expelled from the winding station.

In all the examples described above, the fourth roller (R4) is held in an inoperative position, i.e. out of contact with the log being formed, until the diameter of the latter is lower than a first predetermined value, after which it is placed in operating position, i.e. in contact with the log in formation, until the diameter of the latter assumes a second predetermined final value greater than the first, so that in a first step which ends with the achievement of said first predetermined value of the diameter of the log being formed, the winding of the web (3) on the cores (4) is made from the said first, second and third winding roll (R1, R2, R3), and, in a subsequent step, the log is completed in cooperation with the four winding rollers (R1, R2, R3, R4) until said second final value of the log diameter is reached.

Figure 9:
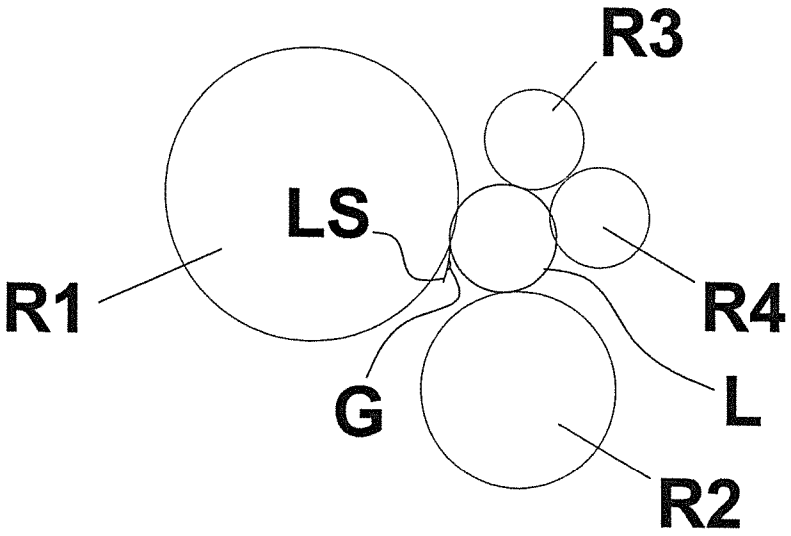
FIG. 9 schematically shows a step that precedes the gluing of the flap when the log is completed.

As mentioned previously, the intervention of the fourth roller (R4) in the final completion phase of the log facilitates the gluing of the last sheet of the web (3) on the underlying paper of the log. In FIG. 9, where the final edge of the last sheet is indicated by the reference "LS", it can be noted, in particular, that the fourth roller (R4) pushes the log (L) exerting a direct pressure towards the first roller (R1). This pressure, exerted directly in the winding station (W), ensures a more effective bonding even when less glue (G) is used.

It is understood that the core (4) feeding system, as well as the web (3) feeding system, the methods of applying the glue on the cores (4) and, more generally, the execution of the phases preceding the winding of the web (3) on the cores (4) may be different from what is described above with reference to the examples shown in the accompanying drawings.

In practice, the details of execution may in any case vary in an equivalent manner as regards the individual elements described and illustrated and their mutual arrangement without departing from the scope of the solution idea adopted and therefore remaining within the limits of the protection conferred by the present patent as defined by the claims.

The invention claimed is:

1. A rewinding machine for the production of logs of paper material, comprising:

a winding station in which a paper web is fed and, in sequence, more tubular cores, and in which station winding are arranged a first, a second and a third winding roller cooperating with each other to wind a predetermined amount of said paper web onto each core, the machine further comprises the winding station having a fourth winding roller which is connected to respective moving means adapted to arrange it in a first inoperative position until the diameter of a log in the winding station is lower than a first predetermined value and a second operating winding position when the diameter of the log being formed is equal to said first predetermined value, said moving means being controlled to maintain the fourth roller in the second operating winding position until the diameter of the log reaches a second final value higher of the first predetermined value such that, in a first phase, which ends with the attainment of said first predetermined value of the diameter of the log being formed, the winding of the web on the cores is realized by said first, second and third winding roller, and, at a subsequent phase, the log is completed in cooperation by the four winding rollers until said second final value of the diameter of the log is reached.

2. The machine according to claim 1, wherein said third roller is connected to respective moving means adapted to move it cyclically to and from a point of arrival of the cores defined between the first and the second roller winding.

3. The machine according to claim 2, wherein the means for moving said third roller comprise a rotary actuator connected to two arms that supports the fourth roller, said arms being adapted to rotate about a pin whose axis is parallel to the axis of the same third roller.

4. The machine according to claim 1, wherein the axes of said four rollers are parallel to each other.

5. The machine according to claim 1, wherein the angular speeds of the third and the fourth winding roller are controlled independently of each other.

6. The machine according to claim 1, wherein the movement of the fourth roller between the inoperative position and the operative winding position is progressive.

7. The machine according to claim 1, wherein the movement of the fourth roller (R4) between the operating winding position and the inoperative position is snap movement.

8. The machine according to claim 1, wherein said means for moving the fourth roller comprise a rotary actuator connected to two arms that support the fourth roller, said arms being adapted to rotate about the axis of the third roller.

9. A Process for the production of logs of paper material, comprising:

supplying a paper web and, in sequence, more tubular cores in a winding station of a rewinding machine, in which winding station are arranged a first, a second and a third winding roller cooperating with each other to wind a predetermined amount of said paper web onto each core, wherein, in said winding station, a fourth winding roller which is arranged in a first inoperative position until the diameter of a log in the winding station is lower than a first predetermined value and a second operating winding position when the diameter of the log being formed is equal to said first predetermined value, said fourth winding roller being maintained in the second operating winding position until the diameter of the log reaches a second final value higher of the first predetermined value such that, in a first phase, which ends with the attainment of said first predetermined value of the diameter of the log being formed, the winding of the web on the cores is realized by said first, second and third winding roller, and, at a subsequent phase, the log is completed in cooperation by the four winding rollers until said second final value of the diameter of the log.

10. The process according to claim 9, wherein said third roller is moved cyclically to and from a point of arrival of the cores defined between the first and the second winding roller.

11. The process according to claim 9, wherein the angular speeds of the third and fourth winding roller are controlled independently of each other.

12. The process according to claim 9, wherein the movement of the fourth roller between the inoperative position and the operative winding position is progressive.

13. The process according to claim 9, wherein the movement of the fourth roller between the operating position of the winding and the inoperative position is a snap movement.

14. The process according to claim 9, wherein said fourth roller exerts on the log a pressure which favors the bonding of the final edge of the paper web on the underlying paper.

15. The process according to claim 9, wherein said fourth roller exerts on the log a pressure directed towards the first roller.

* * * * *